US008234734B2

(12) United States Patent
Perry

(10) Patent No.: US 8,234,734 B2
(45) Date of Patent: Aug. 7, 2012

(54) MODULAR TEETHING RAIL COVER DEVICE

(76) Inventor: Glenda Perry, Atlanta, GA (US)

( * ) Notice: Subject to any disclaimer, the term of this patent is extended or adjusted under 35 U.S.C. 154(b) by 0 days.

(21) Appl. No.: 13/220,264

(22) Filed: Aug. 29, 2011

(65) Prior Publication Data

US 2012/0124751 A1 May 24, 2012

Related U.S. Application Data

(60) Provisional application No. 61/415,582, filed on Nov. 19, 2010.

(51) Int. Cl.
*A47D 15/00* (2006.01)
*A47D 7/00* (2006.01)
*A47D 13/06* (2006.01)

(52) U.S. Cl. ..... 5/663; 5/424; 5/93.1

(58) Field of Classification Search ..... 5/93.1, 5/655, 663, 946, 424, 201, 285, 286; 248/345.1
See application file for complete search history.

(56) References Cited

U.S. PATENT DOCUMENTS 2,303,223 A 11/1942 Murray et al.
2,355,525 A * 8/1944 Giesler ..... 5/93.1
2,636,189 A 4/1953 Feldman
3,627,251 A 12/1971 Paulison
4,361,919 A * 12/1982 Hull ..... 5/93.2
4,525,883 A * 7/1985 Necowitz ..... 5/93.2
4,703,524 A * 11/1987 Brunner et al. ..... 5/93.1
4,955,914 A 9/1990 Caniglia et al.
5,072,464 A * 12/1991 Draheim et al. ..... 5/93.1
5,077,846 A * 1/1992 Wheeler et al. ..... 5/93.2
5,535,457 A * 7/1996 Welsh et al. ..... 5/93.1
5,678,260 A * 10/1997 Belson ..... 5/93.1
5,787,524 A * 8/1998 Butnik ..... 5/93.1
D403,540 S * 1/1999 Williams ..... D6/503
6,651,275 B1 * 11/2003 Rummell ..... 5/99.1
7,003,823 B1 * 2/2006 Reed et al. ..... 5/424

* cited by examiner

*Primary Examiner* — Robert G Santos
(74) *Attorney, Agent, or Firm* — Daniel Boudwin

(57) ABSTRACT

A baby crib rail device is provided for assisting an infant with relieving pain associated with teething. The device comprises a plurality of crib rail covers removably secure to the guard-rail of a child's crib or playpen. Rail covers consist of channels having an inverted "U" shaped cross-section. The covers are secured to an infant crib guardrail by placing the rail through the open bottom of a crib rail cover and pushing downward to secure its location. Sections of rail cover are removably securable to each other in an end-to-end structure that results in an elongated crib rail cover. The covers may be constructed of a soft, durable, sanitizable material such as rubber or plastic. The surfaces of the different rail covers may have a variety of surface contours to provide different types of gum stimulation for teething infants. Rail covers may be arranged in any desired configuration according to the needs or interests of a child.

8 Claims, 2 Drawing Sheets

MODULAR TEETHING RAIL COVER DEVICE

CROSS REFERENCE TO RELATED APPLICATION

This application claims the benefit of U.S. Provisional Application No. 61/415,182 filed on Nov. 19, 2010, entitled "Teething Ring."

BACKGROUND OF THE INVENTION

1. Field of the Invention

The present invention relates to infant teething toy device, more specifically to a teething toy that is removably securable to the top of a crib or playpen guardrail.

Teething devices for infants such as teething rings or toys are well known in the art and come in a variety of shapes and sizes. These devices are used by babies around the world to alleviate pain associated with teeth cutting through the infant's gums. Teething toys are typically placed in the mouth of an infant so that it may chew on the teething toy to stimulate the gums and aid the teeth in cutting through. Infant caregivers will often carry such teething devices with them and provide the toy to the infant when the he or she is in discomfort.

Traditional teething devices rely on the baby or the caregiver to hold the toy steady while the baby chews. This approach is problematic because of the lack of dexterity possessed by most infants. When an infant uses a teething device and then drops it, the device can become contaminated by dirt and debris. This dirt and debris is potentially harmful to an infant and must be cleaned prior to the continued use of the teething toy. Delays experienced while cleaning a teething toy can result in extended discomfort or pain for the infant. To reduce the amount of discomfort they experience infants will often resort to chewing on nearby objects such as furniture, crib rails, or even the infant's knuckles if no teething device is available. Over time this practice can lead to damage to an infant's crib, playpen, hands, and knuckles.

2. Description of the Prior Art

Devices have been created that attach to a child's wrist; however these are not ideal for use by an infant in a crib or playpen as they require supervision by a parent or caretaker to prevent a child's wrist from becoming entangled or caught in crib bars. Other devices have been developed that attach to a crib or crib guardrail. Such devices are problematic because they require permanent modification to the crib or are not easily removable by a parent or caretaker. An easily removable crib rail having modular parts is needed in the art to provide relief from infant gum pain while protecting the underlying crib from damage.

The prior art contains a variety of infant teething rail devices for relieving the pain associated with cutting of a baby's teeth while protecting the structural integrity of crib or playpen guardrails. These devices have familiar design and structural elements for the purposes of providing an infant in a crib with a teething toy to chew on; however they are not adapted for the task of providing easily removable, modular elements therefor.

Paulison, U.S. Pat. No. 3,627,251 discloses a teething guard device. Edging strips are described for preventing a child from chewing on the top of a crib or play pen. The rails are applied to the top and inside walls of crib. Extruded strips of soft synthetic plastic are formed into a rail having an inverted L-shaped cross section. A coextensive web portion extends perpendicularly inward from a central portion of the strip, along a top-covering portion. Serrated sidewalls operatively connect to cooperative slots disposed centrally along the top of a crib or playpen rail to which the teething guard edging strip is applied. The teething rail of Paulison requires a specific means for securing the device to a crib or playpen rail such as a sawtooth latch; the present invention does not require any such securing means. Additionally the present invention discloses a teething rail having an inverted U-shape, not an L-shape.

Feldman, U.S. Pat. No. 2,636,189 discloses a teething rail sheath for a crib guardrail comprising a top portion, two side portions, and a center portion. Said side portions are affixed to said top portion at opposing edges thereof. The center portion is affixed to said top portion's central area and extends downward such that it is disposed between the side portions. In cross section the device has a "W"-shape. The side portions are angled inward towards each other as they extend downward from the top portion. This angling promotes grip on a crib guardrail. The center portion of the device is intended to fit within a groove on the top surface of a crib guardrail and provide grip that assists in securing the device to a rail. The present invention does not require a center portion to assist in securing the device to a crib or playpen rail. The device of Feldman has a cross-sectional shape of a "W" while the present invention has a cross-sectional shape of a "U". The "W" shape requires a specifically-designed rail for its use, wherein a central groove is located along the upper portion of the rail to accommodate the sheath cross section. The present invention can work on any generic, rectangular cross section of crib guard rail.

Caniglia et al, U.S. Pat. No. 4,955,914 discloses a teething rail for use with the circular handle of a shopping cart. The teething rail can be snapped onto and off of the handle of a shopping cart and can be chewed safely by a teething baby when riding in the seat of the shopping cart. The teething rail is a split tube that preferably has a center portion with round raised elements on which the baby can chew to stimulate his or her gums. Caniglia does not disclose a teething rail having a U-shaped cross section or a length suitable for enclosing the guardrail of a crib or playpen. Caniglia also does not disclose modular sections of the teething rail that are alignable and interchangeable to form an extended length of teething guard.

Murray et al, U.S. Pat. No. 2,303,223 discloses a teething toy that is attachable to the rails of a baby crib. The teething toy comprises a pair of elastic wires secured to a crib at opposing ends by a pair of securing assemblies, a teething toy secured to and disposed between said elastic wires, and a noisemaker secured to said teething ring. In the preferred embodiment the teething ring has an animal shape and is formed of soft durable material. The teething ring is secured at a top end to a first elastic wire and at a bottom end to a second elastic wire to provide a child with the ability to tug on and move the teething ring. A noisemaker such as a bell is secured to the teething ring so that a gentle noise is made when an infant uses the teething ring. Murray does not describe a rail guard that removably secures to the top of a crib or playpen guardrail. Murray's teething element is preferably shaped like an animal or toy not formed in the shape of a rail sheath like that of the present invention.

None of these devices disclose a modular teething rail that is removably securable to a crib or playpen guardrail having a variety of arrangements. The devices disclosed by the prior art do not address the need for easily removable and modular elements that form a continuous length of aligned teething rail covers. The current invention relates to a device for alleviating gum pain of a teething infant while protecting the structural integrity of a crib guardrail, wherein shorter sections may be aligned and overlapped to form an elongated length that covers an entire crib guard rail. The shape of the covers are U-shaped, while their exterior surface comprises raised features to stimulate gum pain relief and gum separation for underlying tooth penetration. It substantially diverges in structural elements from the prior art; consequently it is clear that there is a need in the art for an improvement to the existing teething rail devices. In this regard the instant invention substantially fulfills these needs.

SUMMARY OF THE INVENTION

In view of the foregoing disadvantages inherent in the known types of infant teething rail devices now present in the prior art, the present invention provides a new, easily removable and modular teething rail wherein the same can be utilized for providing convenience for the user when installing, removing, or aligning several elements of the device to form a cohesive cover for a length of crib guardrail. The device comprises a plurality of crib rail covers that attach to the top of an infant's crib or playpen guardrail. In cross-section the crib rail covers comprise an inverted "U" shape, whereby the shape may be curved or rectangular in order to fit a variety of guardrail forms. The rail covers snap onto the top of a crib or playpen guardrail by aligning the open bottom of the rail cover over the top surface of a guardrail and exerting downward pressure. In this manner a rail cover is removably secured to a guardrail and snuggly abuts against the top surface thereof. Attaching the device to an infant's crib rail reduces the likelihood of the teething toy falling on the floor where it can collect dirt and bacteria.

The surface of a rail cover described by the present invention may be smooth, or preferably covered in a variety of nubs or surface contours. A parent can mix and match rail covers having different surface contours in order to provide a child with varied chewing options. Teething infants often experience fluctuating levels of gum discomfort, which are alleviated by different chewing options that provide differing levels of gum stimulation. To accomplish this goal a parent may place the different rail covers in any desired alignment and snap them onto a crib guard rail such that an end of a first rail cover abuts against an end of a second rail cover, and so on to form a cohesive cover along the entire length of the guardrail. The rail covers may come in a variety of colors or may have graphic designs decorating their top surfaces in order to provide visual stimulation to a child in addition to relieving gum pain.

In an alternative embodiment each rail cover has an overlay portion disposed at a first end. A second end of the rail cover has an indented portion of equal volume of that of the overlay portion. The rail covers may be removably secured together by snapping a first cover onto the guard rail and then positioning the overlay portion of the second rail cover over the indented portion of the first rail cover, then snapping the second cover onto the crib guardrail so that the two rail covers lay flush. In any embodiment, the device may be constructed of any soft, durable and sanitizable material such as rubber or plastic. The length and circumference of the device elements may vary as needed to fit different types of crib and playpen guardrails.

It is therefore an object of the present invention to provide a new and improved infant teething rail device having all of the advantages of the prior art and none of the disadvantages.

Another object of the present invention is to provide a new and improved infant teething rail device providing modular elements that provide a child with a variety of gum stimulation experiences.

Still another object of the present invention is to provide a new and improved infant teething rail device that protects the structural integrity and finish of a crib or playpen guardrail from damage caused by chewing infants.

A further object of the present invention is to provide a new and improved infant teething rail device that may be removably secured to a crib or playpen guard rail quickly and easily a parent, but is unlikely to be removed by a child.

Yet another object of the present invention is to provide a new and improved infant teething rail cover of shorter length that can be aligned with a plurality of other covers, forming a cohesive length of covers positioned end to end along the entire length of guardrail.

Yet another object of the present invention is to provide a new and improved infant teething rail device having resilient and durable construction.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein like numeral references are utilized throughout.

DETAILED DESCRIPTION OF THE INVENTION

Figure 1:
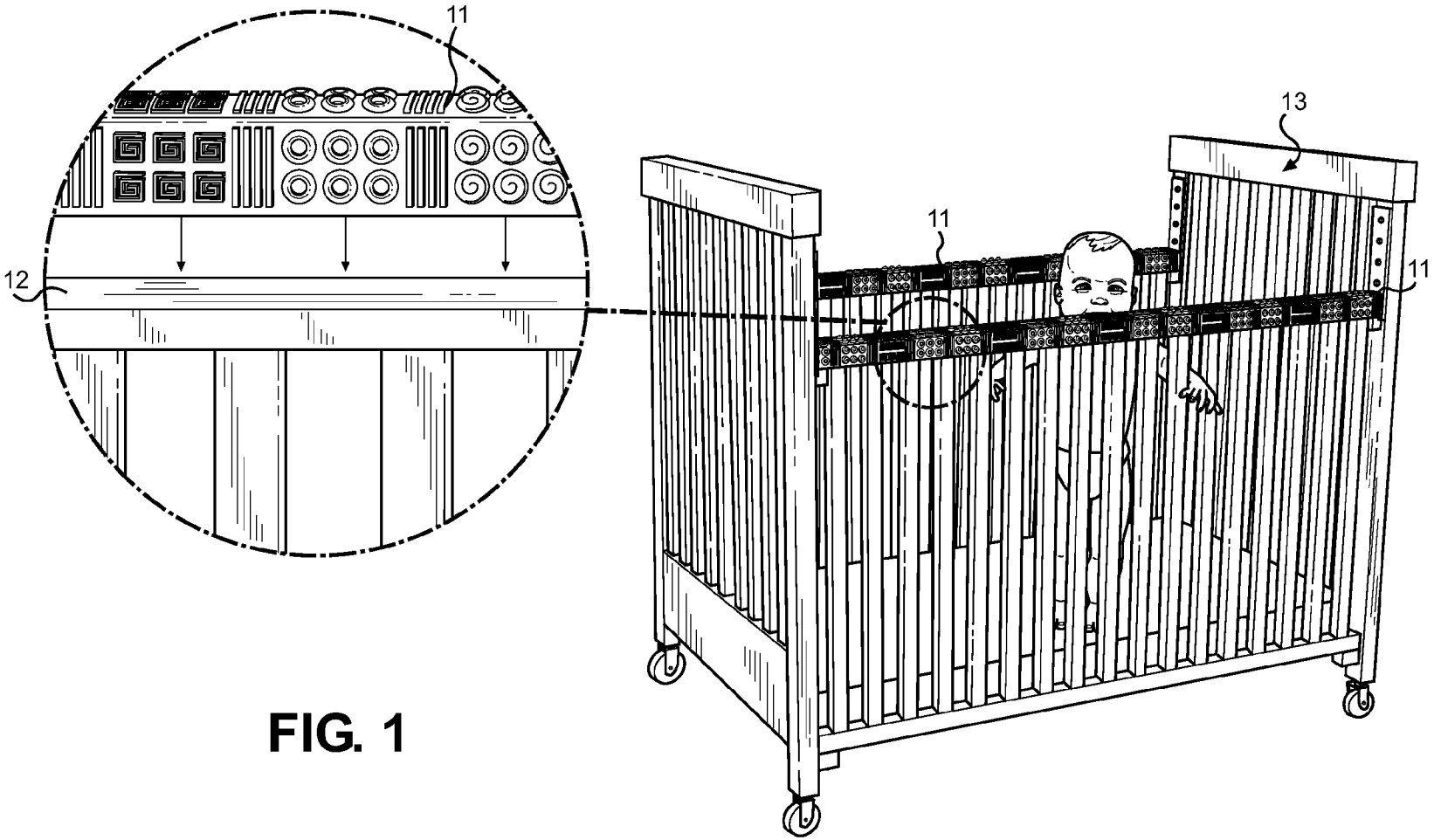
FIG. 1 shows a perspective view of an infant teething rail according to the present invention as used on the top of a baby crib guardrail. A magnified view of the device being installed on the top surface of a guardrail is shown.

Reference is made herein to the attached drawings. Like reference numerals are used throughout the drawings to depict like or similar elements of the infant teething rail device. For the purposes of presenting a brief and clear description of the present invention, the preferred embodiment will be discussed as used for providing relief from gum pain while protecting the surface of a crib guardrail. This is for representative purposes only and should not be considered to be limiting in any respect.

Referring now to FIG. 1, there is shown an infant teething toy device according to the present invention. The device comprises a plurality of crib rail covers 11 that are removably securable to the guardrail 12 of a baby crib 13 or playpen. The crib rail covers are removably secured in a customizable end-to-end configuration along a guardrail to provide a child with relief from the pain of cutting teeth and protect the guardrail from damage. Each member has a first end and a second end, and has the shape of a sheath with a "U"-shaped cross-section. The open bottom of the rail cover is adapted to flexibly receive a guardrail. When the device is installed, the inner surface of each rail cover snuggly abuts against the top and side surfaces of a guardrail. The ends of the removably secured rail covers align with each other to form an elongated rail cover comprises of individual rail cover sections. The configuration of rail cover sections is customizable according to the chewing needs or aesthetic preferences of a child.

Figure 2:
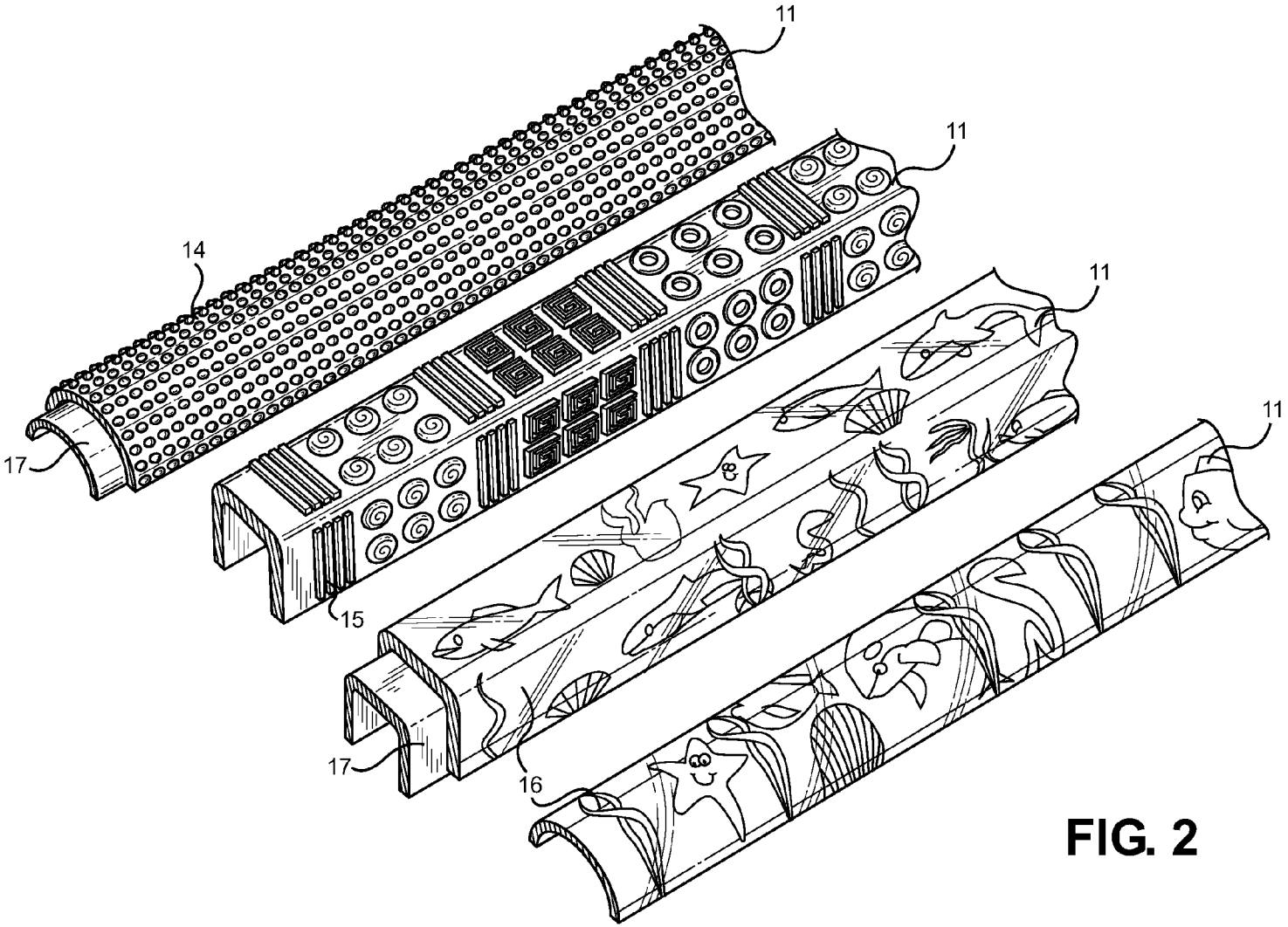
FIG. 2 shows a perspective view of several varieties of rail cover elements according to the present infant teething rail device.

Referring now to FIG. 2, there is shown a set of rail covers 11 having a variety of surface contours. In one embodiment, soft circular nubs 14 cover the surface of the rail cover. In another embodiment, a plurality of different contours 15 such as raised geometric shapes may be disposed along the surface of the rail cover. In yet another embodiment, the surface of a rail cover may be smooth and have a themed image 16 like that of an underwater scene. The rail covers may be manufactured with many different color options. Because the rail covers are modular, a parent or caretaker may install or uninstall the portions in any desired configuration to provide a child with a variety of chewing options and visual stimuli.

In another alternative embodiment, the rail covers may be removably secured to adjacent rail covers to reduce sliding of the portions along a guardrail. Each rail cover 11 has a first end having an overlay portion disposed at a first end. A second end of the rail cover has an indented portion 17 of equal volume of that of the overlay portion. A plurality of rail covers may then be removably secured together and aligned by positioning the overlay of a first rail cover section over the indented portion 17 of a second rail cover section and snapping both sections onto a crib guard rail. Once installed, the upper surfaces of the rail covers align to form a cohesive surface along the length of the guardrail.

In any embodiment, the device may be constructed of a soft, durable and sanitizable material such as rubber, plastic or other suitable material known to one skilled in the art of baby chew toys. The inner surface of a rail cover may have a tacky coating to promote better grip on a guardrail if desired, although the nature of the material should provide a high level of friction to prevent relative movement. The length and circumference of the device elements may vary as needed to fit different types of crib and playpen guardrails.

In use a parent or caretaker places the bottom opening of a desired rail cover over the top surface of a section of a crib or playpen guardrail. The user then presses downward firmly on the rail cover to snap it onto the section of guardrail. This process is repeated with subsequent rail covers, which are positioned so that their respective end portions abut, forming a single, elongated rail cover member. A child may then chew on a rail cover to alleviate pain associated with teething. The variety of contoured surfaces offers different types of gum stimulation when chewed on by a child. A parent can remove or replace portions of the device by lifting on one end of the rail cover and peeling it back along the surface of the guardrail. The device's modularity provides a parent with the option to shift the rail covers into different configurations according to an infant's pain relief needs and visual interests.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An infant teething toy device, comprising:

a crib rail cover having an inverted U-shaped cross-section with an open bottom;

said crib rail open bottom adapted to receive a guard rail;

said crib rail covers having an outer surface with a variety of raised contours or graphic designs;

an overlay portion extending laterally §from said first end of a crib rail cover and an indented portion of equal volume to said overlay portion extending laterally from said second end of a crib rail cover, wherein said indented portion of any crib rail cover is adapted to engage with said overlay portion of any other crib rail cover;

said first end of a rail cover connectively securable to said second end of an adjacent rail cover by placing said overlay portion over said indented portion;

said crib rail cover being removably attached along a guardrail in any number or order desired by a user.

2. The teething device of claim 1, wherein a plurality of crib rail covers may be aligned along said guard rail to form a cohesive cover along said guard rail length.

3. An infant teething toy device, comprising:

a plurality of crib rail cover each of said crib rail covers having an inverted U-shaped cross-section with an open bottom, a first end and a second end;

said crib rail open bottom adapted to receive a guard rail;

an overlay portion extending laterally from said first end of a crib rail cover and an indented portion of equal volume to said overlay portion extending laterally from said second end of a crib rail cover, wherein said indented portion of any crib rail cover is adapted to engage with said overlay portion of any other crib rail cover;

said first end of a rail cover connectively securable to said second end of an adjacent rail cover by placing said overlay portion over said indented portion;

said crib rail cover being removably attached along a guardrail in any number or order desired by a user.

4. The teething device of claim 3, wherein any of said crib rail covers has an outer surface contour.

5. The teething device of claim 4, wherein said surface contour comprises rounded nubs.

6. The teething device of claim 4, wherein said surface contour comprises raised geometric shapes.

7. The teething device of claim 3, wherein graphic designs are displayed on the outer surfaces of said crib rail covers.

8. The teething device of claim 3, wherein a plurality of crib rail covers may be aligned along said guard rail to form a cohesive cover along said guard rail length.

* * * * *